United States Patent [19]

Addiego

[11] Patent Number: 4,818,120

[45] Date of Patent: Apr. 4, 1989

[54] OPENABLE AND RECLOSABLE TAMPER EVIDENT BAG TAG

[75] Inventor: Joseph Addiego, Pinebrook, N.J.

[73] Assignee: Nabisco Brands, Inc., Parsippany, N.J.

[21] Appl. No.: 75,516

[22] Filed: Jul. 20, 1987

[51] Int. Cl.[4] ..... B65D 33/14

[52] U.S. Cl. ..... 383/5; 383/89; 383/91

[58] Field of Search ..... 383/5, 61, 78, 83, 84, 383/85, 88, 89, 90, 91; 206/61

[56] References Cited

U.S. PATENT DOCUMENTS

| | | | |
|---|---|---|---|
| 1,979,157 | 10/1934 | Higginbottom | 383/91 |
| 2,017,704 | 10/1935 | Rose | 229/65 |
| 2,051,106 | 8/1936 | Rosen | 229/62 |
| 2,103,840 | 12/1937 | Bauer | 229/65 |
| 2,138,066 | 11/1938 | Matchett | 229/65 |
| 2,159,976 | 4/1939 | Matchett | 229/65 |
| 2,197,490 | 4/1940 | Williams et al. | 229/62 |
| 2,241,835 | 5/1941 | Wentz | 229/65 |
| 2,246,596 | 6/1941 | Moore | 383/5 |
| 3,069,066 | 12/1962 | Peckham | 229/62 |
| 3,545,668 | 12/1970 | Hultberg | 229/65 |
| 3,784,087 | 1/1974 | Styers | 229/62 |
| 4,394,955 | 7/1983 | Raines et al. | 229/65 |

FOREIGN PATENT DOCUMENTS

| | | | |
|---|---|---|---|
| 1100511 | 9/1955 | France | 383/91 |
| 374883 | 3/1964 | Switzerland | 383/89 |

*Primary Examiner*—Willis Little

*Attorney, Agent, or Firm*—Richard Kornutik

[57] ABSTRACT

An openable and recloseable tamper evident bag tag is disclosed. Initial opening of a transparent plastic bag provided with the invention breaks frangible connections of end tabs wrapped and adhesively secured around vertical edges of a folded double sectional or triple sectional support member and unsealed bag opening. Tampering is easily discernable from the jagged edges of the broken frangible connections which are formed when the sections of the support member are unfolded. Once opened, the bag can be reclosed and secured by folding the bag opening and sections of the support member together and folding a tin-tie which overlies the end tabs around the vertical edges of the folded bag opening and sectioned support member.

18 Claims, 2 Drawing Sheets

2
4
6
8
10
12
14
16
18
20
22
24
26
28
30
32
34
36
38
40
42
44
46
48
50
52
54
56
58
60
62
64
66
68
70
72
74

FIG. 3
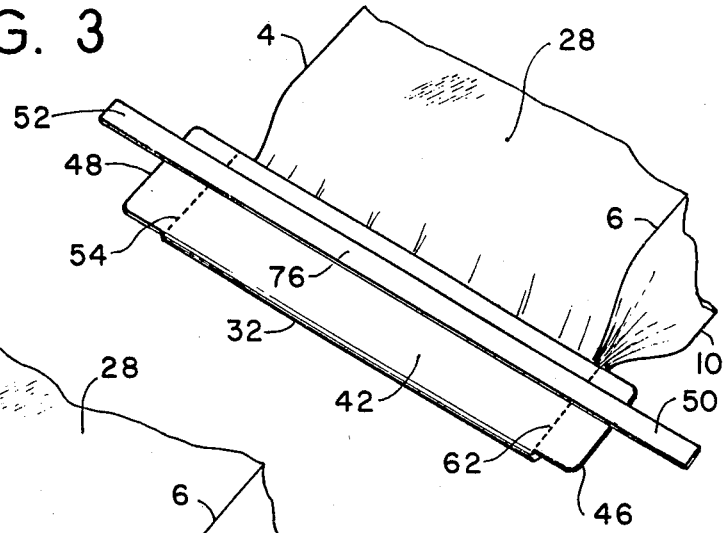
FIG. 3A
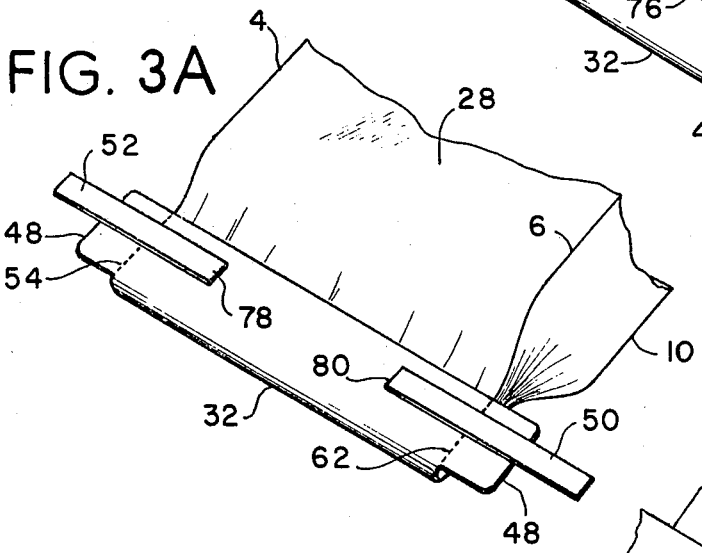
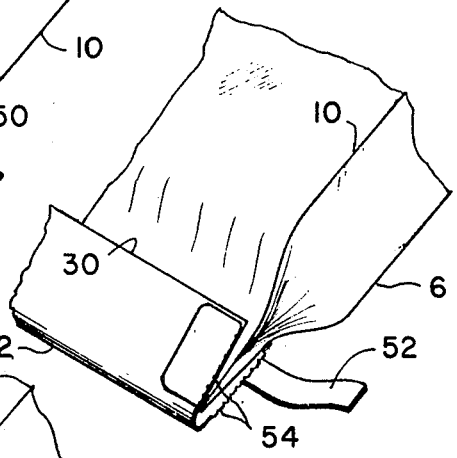
FIG. 6
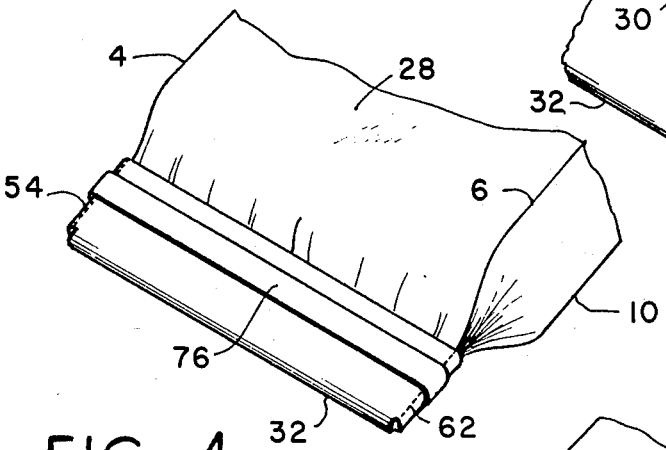
FIG. 4
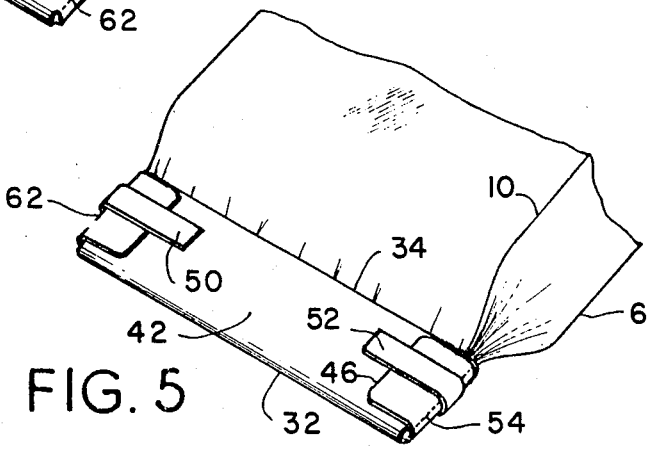
FIG. 5

OPENABLE AND RECLOSABLE TAMPER EVIDENT BAG TAG

BACKGROUND OF THE INVENTION

1. Field of the Invention:

The invention relates to flexible transparent film packages having closures with tearing or breaking means. More in particular, the invention relates to receptacles having transparent, plastic bag walls designed to be rolled together and having separate securing elements which extend substantially 180° or more around the side edge of the roll wherein the securing elements include a dead fold.

2. Background Information:

Disposable, resealable bags have many uses in the food industry some of the more notable being the storage and displaying of ready to eat bakery products. If there are a lot of bakery products within a bag then problems arise concerning keeping the products contained therein fresh after multiple openings and reclosings of the bag. Additionally, concern in the market for detection of product tampering has dictated that packaging of orally consumable products contain some means for detection of product tampering. Thus, packaging of ready to eat food products which must be kept fresh has become complicated.

U.S. Pat. No. 2,197,490 to Williams et al. discloses a sealed bag and method producing a sealed bag. A frangible strip of paper is attached to a face of a bag projecting beyond the top and sides of the bag. Flaps at the top and sides are adhesively attached to the bag to secure the closed bag. The bag is opened by ripping one of the lateral side flaps. Means for reclosing the bag are not disclosed.

U.S. Pat. No. 2,138,066 to Matchett discloses means for sealing tin-tie bags. A tin-tie is attached to a support member which in turn is attached to an outer surface of a wall of a bag adjacent the top. The top of the bag is folded over and downwardly and the tin-tie is folded around the lateral sides to hold the fold. No support member having laterally extended areas is disclosed.

U.S. Pat. No. 2,159,976 to Matchett discloses means for sealing tin-tie bags. A flap is attached to a wall of a container near the open end. The flap has a tin-tie extending across the flap with ends extending beyond the lateral sides. Tabs depend from the ties which seal the container where the flap is folded over. Matchett does not disclose end tabs extending from lateral sides of the flap which have perforations for ripping.

U.S. Pat. No. 2,103,840 to Bauer discloses package fastening means. A paper sheath is secured upon one side of a paper bag adjacent the top. The sheath has portions extending beyond the sides. Within the sheath is a metal tie consisting of a flat strip of foldable metal. The bag is closed by bending the extended areas inwardly flat against the sheath and folding top portions of the bag downwardly and inwardly flat against the lower portions and taping. There is no flat support member having end tabs with perforations wherein a metal tie is attached on outer surfaces of the support member.

U.S. Pat. No. 3,545,668 to Hultberg discloses a recloseable bag. A support member is attached to outer surfaces of a bag adjacent the top. A tin-tie is attached to the support member. The member is folded downwardly and inwardly for closing th bag opening. The tin-tie is folded around the sides of the folded member.

No laterally extended areas of the support member is disclosed.

U.S. Pat. No. 3,784,087 to Styers discloses a tamperproof, recloseable package and closure therefor. A closure strip having a flat, deformable wire positioned therein is attached to an outer wall of a bag adjacent the top. When the top is folded over the portion of the closure containing the deformable wire, the envelope portion of the closure containing the deformable wire will not seal thereto so that the end tab portions of the enclosed wire can be unfolded from the bag, permitting the bag to be opened. No support member having extended areas with perforations along lateral sides is disclosed.

U.S. Pat. No. 2,051,106 to Rosen discloses a bag closure. A blank having articulatable sections is attached to an outer wall of a bag adjacent the open end. Tabs extend from the lateral sides and fold around and close the sides of the folded-over top. The tabs are not perforated for easy breaking and no tin-tie is disclosed.

U.S. Pat. No. 4,394,955 to Raines et al. discloses a bag with bendable retainer strip, and method of making the same. A recloseable bag is provided with a lip projection above the bag mouth which carries a bendable retaining strip having opposite end tab extensions. No end tabs having perforations on lateral sides is disclosed.

U.S. Pat. No. 2,017,704 to Rose discloses a bag fastener. A tin-tie is attached to top portions of a bag such that folded over end portions are secured. No support member having extending tabs with perforations is disclosed.

U.S. Pat. No. 3,069,066 to Peckham discloses closure means. A sealable bag closure for cookies and the like has a blank with several foldable panels having several adhesive areas attached adjacent the bag opening. No support member having laterally extending tabs is disclosed.

U.S. Pat. No. 2,241,835 to Wentz discloses a container closure. Flap-like means project upwardly from aligned edges at the opening of a container; a plurality of bendable tongue-like members are secured thereto. No support member having lateral extensions with perforations is disclosed.

The prior art does not teach a transparent plastic disposable bag which can be opened, reopened, closed and reclosed a multitude of times wherein tampering with the bag is ascertainable by a purchaser. The absence of such a teaching is due to the problems associated with transparent plastic bags. For example, transparent plastic bags currently do not have what is referred to as "good propagational tear strength", i.e., tearing of the plastic material destroys the integrity of the bag. In contrast, bags made of paper can be torn with out destroying the integrity of the bag. Another problem associated with transparent plastic bags is that they do not have the ability for maintaining dead folds, i.e., when the plastic material is folded the fold does not stay folded. In contrast, paper when folded will tend to stay folded. Folding provides an efficient barrier to the outside environment such that ready-to-eat food can be freshly maintained within a bag having its opening folded shut Transparent plastic material is the material of choice for displaying ready to eat goods such as cookies and the like. A consumer is able to see the contents of the package made from transparent plastic. Accordingly, there is a long felt yet unsolved need in the art for a transparent plastic openable and reclosable tamper evident bag.

SUMMARY OF THE INVENTION

The invention is a receptacle for baked goods and the like. In the preferred embodiment a recloseable, tamper resistant disposable container has a transparent plastic bag having opposed first and second bag walls with their opposite vertical edges and their opposite bottom edges attached to one another to provide a bag having a top bag mouth opening.

Attached to an outside surface of one of the walls near the opening is a flat rigid support member. The support member extends across a width of the wall and has at least one score line along the width for folding one portion of the support member over on another portion of the support member. The support member is preferably made from a material capable of forming dead folds, e.g., paper. The folding encloses the bag mouth opening.

The container is further provided with first and second end tabs having adhesive surfaces connected with frangible connections to opposite lateral sides of one portion of the support member. The end tabs are capable of folding along the frangible connections around the vertical edges of the bag . The adhesive surfaces are adapted to attach to a portion of the support member when the portion is folded over the bag opening.

The invention further comprises a tin-tie attached to the support member which has opposite ends coextensive with the end tabs for releasibly securing the folded over bag opening.

The support member can be a rectangular piece of cardboard or the like attached by an adhesive glue to an outer wall of the bag near the bag opening. The support member can be scored latitudinally with fold lines or score lines which divide the support member into two or more sections. If the support member comprises two portions, the end tabs may extend from either the upper or lower portion. If the support member comprises three sections then the end tabs may extend from either the middle or lower portion. The location of the end tabs is important for wrapping completely around the vertical edges of the package which includes the folded over bag opening and support member portions.

The material from which the bag is constructed is preferably a paper or plastic material having gusseted sides capable of being easily folded to a flat configuration near the bag opening.

The support member can extend beyond the sides of the bag as well as beyond the top of the bag.

The end tabs can be extensions of the support member which extend laterally beyond the vertical edges of the bag. The end tabs are, preferably, connected to the support member by linear perforated lines or some other frangible connection.

Attached to the surface of the support member is at least one tin-tie which is attached to the support member by an adhesive or other attachment means. The opposite ends of the tin-tie are coextensive with the end tabs and, preferably, extend beyond the lateral sides of the end tabs.

In operation, the invention is filled with a quantity of baked goods such as a tray of cookies or the like. Once filled, the upper portion of the support member is folded down over and adjacent to lower portions of the support member for sandwiching therebetween and folding therewith the upper portions of the bag and bag opening. It is preferred that the support member be in three sections to enable a double fold. It is been discovered that the double fold provides the best barrier to the outside environment enabling baked products to remain fresh for extremely long periods of time despite numerous opening and reclosing of the package. Once the upper portions of the support member are adjacent the lower portion of the support member, the end tabs are folded around the vertical edges and attached by the adhesive surfaces to the upper portion of the support member. Thus, goods may be packaged and shelved for the marketplace.

To open the invention, the purchaser breaks the end tabs along the frangible connections and unfolds the tin-ties such that the folded over bag end may be unfolded and access to the contents within secured. To reclose the invention, the upper portion of the unfolded support member is folded downward together with the upper portion of the bag and the tin-tie is the secured around the vertical edges of the sides.

The invention is tamper evident because to gain entry into the bag once end tabs have been adhesively sealed, the frangible connections must be broken. The consumer who obtains a bag wherein the frangible connections have been broken, will know there is a possibility that the goods within have been contaminated due to the readily evident torn edges.

Accordingly, it is the object of this invention to provide a tamper evident system for a recloseable container.

It is another object of the invention to provide a container which will maintain the freshness of baked goods locate within.

It is still another object of the invention to provide a container which is capable of multiple opening and reclosings while still protecting the freshness of baked goods located within.

It is yet another object of the invention to provide a transparent plastic bag container having a tag attached thereto which enables the plastic bag to have dead folds at the opened end to provide an efficient barrier, to be opened and reclosed numerous times while keeping baked goods and the like located therein fresh and to provide an indication as to whether or not the bag has been compromised.

These and other and further objects and features of the invention are apparent in the disclosure which includes the foregoing and following specification, claims and drawings.

BRIEF DESCRIPTION OF THE DRAWINGS

While the specification concludes with claims particularly pointing out and distinctly claiming the subject matter that is regarded as forming the present invention, it is believed that the invention will be better understood from the following description accompanied by the following drawings in which:

FIG. 3 is an elevated perspective of a closure element according to the invention showing a one piece tin-tie;

FIG. 3A is an elevated perspective showing an alternative embodiment to the closure of FIG. 3;

FIG. 4 is an elevated perspective of one side of the closure element fully assembled and ready for market;

FIG. 5 is an elevated perspective of the closure element of the invention showing the opposite side from that shown in FIG. 4;

FIG. 6 is an elevated perspective in partial cutaway showing a broken frangible connection and unfolded tin-tie.

DESCRIPTION OF THE PREFERRED EMBODIMENTS

Figures 1, 1A, 2:
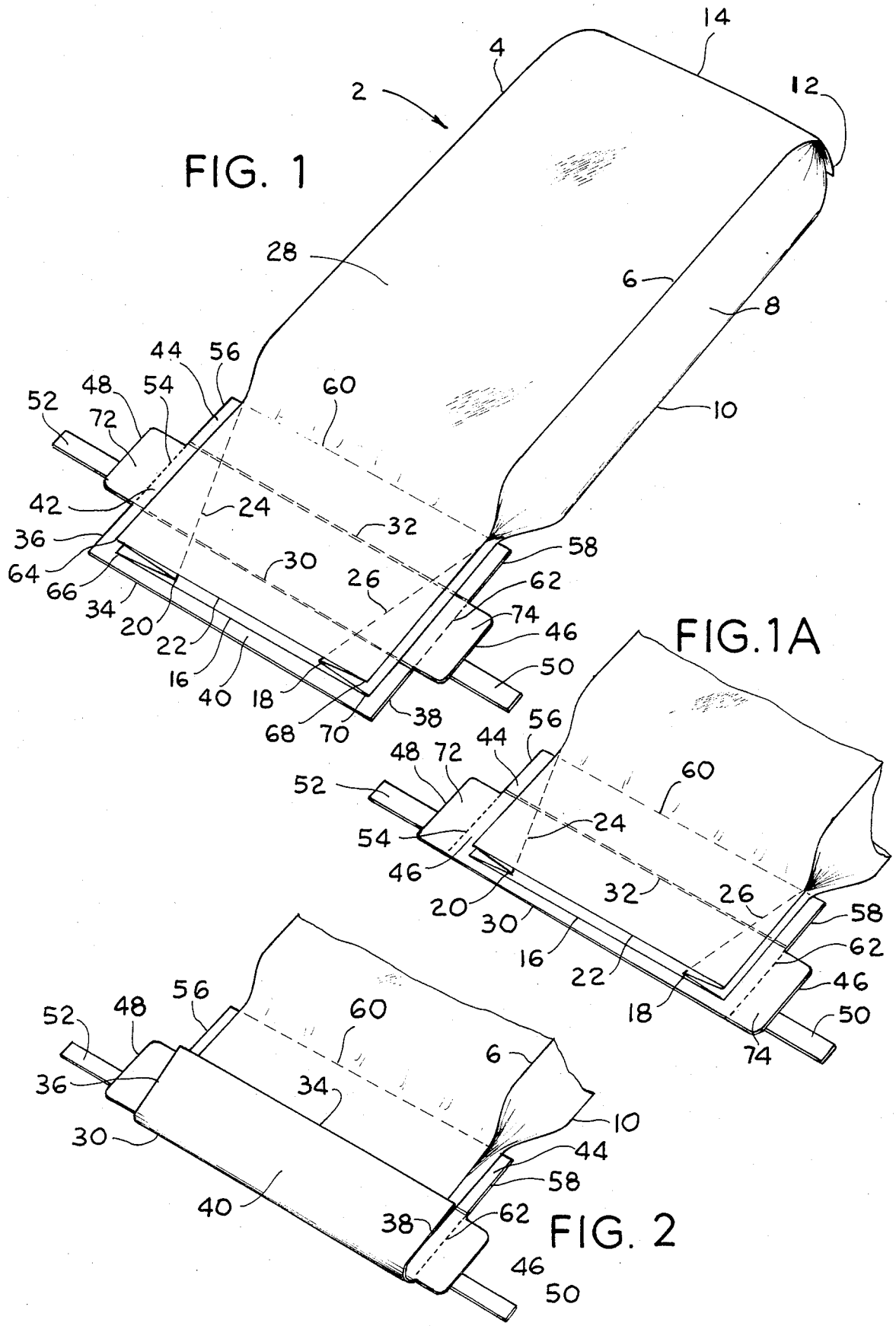
FIG. 1 is an elevated perspective of the invention.
FIG. 1A is an elevated perspective of an alternative to the closure elements disclosed in FIG. 1.
FIG. 2 is an elevated perspective of the closure elements of FIG. 1 partially folded.

The preferred embodiments are disclosed in FIGS. 1–6. The invention is primarily a transparent plastic receptacle or container for the display and storage of baked goods such as cookies, donuts and the like. The bags are preferably large enough to hold a fair quantity of the baked goods so that multiple openings and reclosings of the containers are necessary. When baked goods such as cookies are stored within the container, trays holding the cookies may be used for arranging the cookies within the container. To enable the consumer relatively unimpeded access into and out of the bag, the bag opening must be as fully opened as possible.

FIG. 1 shows the entire container prior to being loaded with baked goods. The transparent, plastic, flexible disposable bag is generally indicated by the No. 2. The bag has a front wall 28 with vertical edges 4, 6 and 10. There is a top edge 22 and a bottom edge 14 for the front wall 28. The number 12 refers to the folded over and sealed end portion. It should be noted that any sort of closing for end portion 12 of the bag ma be used which is permanent.

The preferred material for the bag is polyethylene, polypropylene, polyester or the like. As was stated above these materials do not currently have good propagational tear strength. Thus, closing the opening of a bag by heat sealing will cause the destruction of the bag when opened by a consumer.

The bag 2 is preferably provided with gussets 8 on the side to allow for a reasonable depth for insertion of a variety of configurations of baked goods. The bag 2 is readily collapsible towards the ends 22 and 16. The dotted lines 24 and 26 represent the collapsed line of the gussets defined by corners 18, 68, 70, and 20, 64 and 66.

Attached to a bag wall surface is a support member which is shown in FIG. 1 as having three-sections, i.e., 40, 42 and 44. Attachment of the support member to the clear plastic material is preferably by a typical adhesive material, e.g., hot melt glue. Care must be taken when using heat near the bag material as the bag can melt and be destroyed. The sections are divided by score lines 30 and 32. The score lines stretch across a width of the support member and enable the relative ease of folding the support member over the bag ends 22 and 16. The support member 40, 42 and 44 is preferably a flat rigid piece of cardboard, plastic or the like. As was stated above the triple section support member is the best mode because a double fold can be performed with the triple section version of the support member. The double fold provides the best barrier for protection of the good located within the bag.

The support member 40, 42 and 44 is provided with end tabs 46 and 48. The end tabs are connected to the support member section 42 by frangible connections 54 and 62. The frangible connections can be linear perforations or some other frangible connection. The frangible connections 54 and 62 enable the relative easy folding of the end tabs 46 and 48. End tab surfaces 72 and 74 are provided with adhesive material for attachment to outer portions of the support member 40, 42 and 44. A pressure sensitive material or a hot melt adhesive can be used for adhering the tabs surfaces to the outside portions of the folded over support sections. For the sake of simplicity, it is preferred that the adhesive for the attachment of the tabs be the same as the adhesive for the attachment of the support member.

Extending beyond the end tabs 46 and 48 are the ends of tin-tie 50 and 52. The opposite ends of tin-tie 50 and 52 are coextensive with the end tabs 46 and 48 and are capable of effecting a dead fold along with the folded end tabs 46 and 48.

The edges 36, 56, 38, 58 and 34 of the support member preferably extend beyond the limits 16, 64, 66, 68 and 70 of the bag. The bottom most edge of the support member 60 is located at an area of the bag beyond which goods are stored.

FIG. 1A shows an alternative embodiment of the support member disclosed in FIG. 1. As is readily apparent, the support member of FIG. 1A has two sections divided by score line 32. The upper section 42 contains the end tabs 46 and 48. The two-fold version of the present invention as shown in FIG. 1A provides for more storage space than a three-fold version of the present invention as shown in FIG. 1, given bags of the same dimension; i.e., because the two-fold version omits the first Section 40 of the support member, more of the bag remains available or the storage of food products. Simply put, less header on the bag is used to fold with the support member 42 and 44. The single fold capability of the support member of FIG. 1A is adequate to form a barrier to protect the contents of the package; however, the double fold is a better barrier enabling a longer shelf life of the packaged goods.

FIG. 2 shows the embodiment of FIG. 1 having one section 40 of the support member folded over. As shown, support end edge 34 is folded along score line 30 to bring section 40 adjacent to the section 42 of the support member bearing the end tabs 48 and 46. The header portion of the bag 2 has been folded thereunder. As is readily apparent from a study of FIG. 2, the end tabs 46 and 48 must extend from the middle 42 or lower 44 sections of support member in order to be capable of completely wrap around the folded vertical edges 64, 66, 68 and 70 of the bag mouth as well as the collapsed gussets 8 (shown in FIG. 1 as dashed lines 24 and 26) and still be adherent to the portion 40 of the support member which has been folded over as described above.

FIG. 3 shows the bag closure, according to the invention, which has been folded along score line 32 and is ready for attachment of the end tabs 48 and 46. There is shown tin-tie 76 which is shown as a unitary piece extending across the width of the support member 42. The tin-tie 76 has opposite ends 52 and 50 which are coextensive with end tabs 46 and 48 and preferably extend beyond edges 46 and 48. Attachment of the tin-tie is in the same manner as described with the attachment of the support member or the end tab surfaces. The tin-tie is attached to the support member but not to the end tabs. Once the frangible connections of the end tabs have been broken, the end tabs stay adhered to a surface of the support member but no longer function in the multiple reopenings and reclosings of the bag. It is the tin-tie which maintains and secures the folds of the support member and bag opening.

FIG. 3A shows an alternate embodiment of the closure FIG. 3. FIG. 3A shows the tin-tie being in two sections. The first section is 52 and 78 has end portion 52 and the second section 80 has end portion 50. The two section tin-tie has the advantage of allowing for graphic advertising art between the sections. Again, note that the tin-tie sections are attached to the support member and not to the end tabs. Attachment of the tin-ties to th end tabs would prevent the bag from being opened without a wire cutter.

FIG. 4 discloses the bag closure fully assembled and ready for presentation to the marketplace. The end tabs have been folded around the vertical edges along frangible lines 54 and 62. The tin-tie 76 is shown with dead folds occurring along the frangible connections 54 and 62.

FIG. 5 shows the reverse side of the fully assembled package according to FIG. 4. As shown, end tabs 46 and 48 have adhesive surfaces fixedly attached to support portion 42. The tin-ties are shown with dead folds around the frangible connections 54 and 62.

FIG. 6 discloses the appearance of the bag according to the invention once the bag has been opened after being sealed in the fashion disclosed in FIGS. 4 and 5. To initially open the bag after being sealed in the fashion as disclosed in FIGS. 4 and 5, the dead fold of the tin-tie 52 is bent back and the edge 30 of section 42 of the support member is pulled up to break the frangible connection 62. Thus, once the connection between the end tabs 46 and 48 and the portion 42 of the support member to which the end tabs 46 and 48 have been adhered along lines 54 and 62 broken, the jagged edges along the frangible connection 54 of the end tab 48 surface will be readily apparent to any consumer. In this way consumers inspecting the fully assembled bag of the invention will be alerted of potential tampering by the existence of jagged edges along the frangible connections 54 and 62 at the end tabs 48 and 46 as disclosed in FIG. 6.

Once the bag according to the invention has been opened as shown in FIG. 6, the bag closure may be fully unfolded as shown in FIGS. 1 and 1A. The bag end edges 22 and 16 of FIG. 1 and IA will then be fully extendable to the full width of the bag and limited only by the width of the gussets.

As this invention may be embodied in several forms without departing from the spirit or characteristics thereof, the present embodiment is therefore illustrative and not restrictive, and since the scope of the invention is defined by the appended claims, all changes that fall within the metes and bounds of the claims or that form their functional as well as their conjointly cooperative equivalents are therefore intended to be embraced by those claims.

What I claim is:

1. An openable and recloseable tamper evident transparent plastic bag container, comprising:

(a) a disposable flexible transparent plastic bag having a front and back wall, a sealed bottom edge, two side gussets and an unsealed opened end;

(b) a thin, flat support member attached to said back wall, said support member having at least one score line disposed thereon, said score line oriented substantially perpendicular to said opened end of said bag, said score line dividing said support member into a plurality of sections, whereby when said sections of said score line a dead fold is effected and said opened of said bag is substantially hermetically sealed (c) end tabs having adhesive surfaces extending outwardly from the edges of one of said sections of said support member on opposite lateral sides of said support member and being frangibly connected thereto, wherein said end tabs are adapted to be folded along the frangible connections with the adhesive surfaces fixedly securing said end tabs to the folded over section of said support member whereby, when said folded over sections of said support member are unfolded, the frangible connections of said end tabs will be broken;

(d) a tin-tie oriented perpendicular to said open end of said bag and affixed to said support member, said tin-tie having opposite ends for releasibly securing together said sections of said support member after said sections have been folded over and onto each other.

2. The container of claim 1 wherein said support member has two score lines dividing the support member into foldable upper, middle and lower sections, wherein said end tabs are located on the middle section, whereby said upper section is foldable with the opened end of the bag over on said middle section, whereby the middle section is thereafter foldable over on said lower section, and whereby said adhesive surfaces are attachable to portions of said lower section.

3. The container of claim 1 wherein said tin-tie is a unitary piece extending across the width of the support member.

4. The container of claim 1 wherein said tin-tie is two end sections attached to opposite sides of said support member.

5. The container of claim 1 wherein said bag comprises polyethylene, polypropylene, polyester or a mixture thereof and the support member is constructed from a stiff cardboard material.

6. The container of claim 5 wherein said bag is gusseted on the sides and the frangible connections are linear perforations.

7. An openable and recloseable tamper evident transparent plastic bag container, comprising:

(a) a disposable flexible transparent plastic bag having an opened end;

(b) a flat support member attached to an outer surface of said bag near said opened end, wherein said flat support member is scored for folding an upper portion of said support member together with the opened end of the bag over and onto a lower portion of said support member;

(c) end tabs having adhesive surfaces extending beyond opposite lateral sides of said bag, wherein said end tabs are frangibly connected to a lower portion of said support member, and wherein said end tabs are adapted to be folded along said frangible connections and fixedly attached to said upper portion of said support member after said upper portion has been folded over (d) a tin-tie attached to said lower portion and having opposite ends extending outwardly beyond said end tabs for releasibly securing the folded over portions of said support member together.

8. The container of claim 7 wherein said support member has two score lines dividing the support member into foldable upper, middle and lower sections, wherein said end tabs are located on the middle section, whereby said upper section is foldable with the opened end of the bag over on said middle section, whereby the middle section is foldable over on said lower section, and whereby said adhesive surfaces are thereafter attachable to portions of said lower section.

9. The container of claim 7 wherein said tin-tie is a unitary piece extending across the width of the support member.

10. The container of claim 7 wherein said tin-tie is two end sections attached to opposite sides of said support member.

11. The container of claim 7 wherein said bag comprises polyethylene, polypropylene, polyester or a mixture thereof and the support member is constructed from a stiff cardboard material.

12. The container of claim 11 wherein said bag is gusseted on the sides for facilitating flat folding of said opened end of said bag and said frangible connections are linear perforations.

13. An openable and recloseable tamper evident transparent plastic bag container, comprising:

(a) a transparent plastic bag having opposed first and second bag walls with their opposite vertical edges and their opposite bottom edges being attached to one another to provide a bag having a top bag mouth opening;

(b) a flat, rigid support member attached to an outside surface of one of the walls near the opening, said support member extending across a width of the wall and having at least one score line along said width for folding one portion of said support member over on another portion of said support member to enclose said bag mouth opening;

(c) first and second end tabs having adhesive surfaces frangibly connected to opposite lateral sides of one portion of said support member for folding around the vertical edges along said frangible connections, said adhesive surfaces being adapted to attach to another portion of said support member when said other portion is folded over said bag opening, whereby opening of said bag involves breaking of said frangible connections;

(d) a tin-tie attached to said support member having opposed ends extending beyond said end tabs for releasibly securing said fold around the vertical edges, whereby said bag is recloseable after said frangible connections have been broken, and whereby previous tampering with the bag can be detected by inspecting the frangible connections.

14. The container of claim 13 wherein said support member has two score lines dividing the support member into foldable upper, middle and lower sections, wherein said end tabs are located on the middle section, whereby said upper section is foldable with the opened end of the bag over on said middle section, whereby the middle section is foldable over on said lower section, and whereby said adhesive surfaces are attachable to portions of said lower section.

15. The container of claim 13 wherein said tin-tie is a unitary piece extending across the width of the support member.

16. The container of claim 13 wherein said tin-tie is two end sections attached to opposite sides of said support member.

17. The container of claim 13 wherein said bag comprises polyethylene, polypropylene, polyester or a mixture thereof and the support member is constructed from a stiff cardboard material.

18. The container of claim 17 wherein said bag is gusseted on the sides and the frangible connections are linear perforations.

* * * * *